US005605493A

United States Patent [19]

Donatelli et al.

[11] Patent Number: 5,605,493

[45] Date of Patent: Feb. 25, 1997

[54] STONE POLISHING APPARATUS AND METHOD

[75] Inventors: Joseph M. Donatelli; Joseph Donatelli; Thomas P. Donatelli; Franklin P. Donatelli, all of Scotch Plains; John A. Castaldo, New Providence, all of N.J.

[73] Assignee: Clarke Industries, Inc., St. Louis, Mo.

[21] Appl. No.: 229,592

[22] Filed: Apr. 19, 1994

[51] Int. Cl.[6] ..... B24B 1/00; B24B 7/18

[52] U.S. Cl. ..... 451/41; 15/49.1; 451/353; 451/550

[58] Field of Search ..... 451/41, 57, 344, 451/350, 548, 352, 550, 353; 15/98, 49.1, 50.3, 320, 340.1

[56] References Cited

U.S. PATENT DOCUMENTS

| | | | |
|---|---|---|---|
| 3,318,053 | 5/1967 | Miller | 451/548 |
| 3,517,466 | 9/1970 | Bouvier | 451/548 X |
| 3,701,221 | 10/1972 | Vinella . | |
| 4,155,596 | 5/1979 | Brejcha | 299/40 |
| 4,317,314 | 3/1982 | Carlstrom et al. . | |
| 4,634,188 | 1/1987 | Persson | 299/39 |
| 4,910,824 | 3/1990 | Nagayama et al. | 451/353 |
| 5,016,310 | 3/1991 | Geyer et al. | 451/353 |
| 5,203,046 | 4/1993 | Shaw | 451/353 |
| 5,309,592 | 3/1994 | Hiratsuka | 451/353 |
| 5,454,752 | 10/1995 | Sexton et al. | 451/548 |

OTHER PUBLICATIONS

Advertising brochure from Clarke Industries, Inc., St. Louis, MO entitled "Clarke Stone Gare System".

Advertising sheet from Clarke Industries, Inc., St. Louis, MO entitled "Product Introduction News", Jul. 1993.

Advertising brochure from The Butcher Company, Marlborough, MA entitled "Butcher's Marble Floor Care", 1991.

Advertising brochure from Nilfisk of Australia Pty. Ltd., Sydney, Australia entitled "Nilfisk".

Technical Bulletin #1 from Nilfisk of America, Inc., Malvern, PA, entitled "Pad Pressure Makes Vitrification Happen", 1990.

Technical Bulletin #2 from Nilfisk of America, Inc., Malvern, PA entitled "Typical Chemical Costs", 1990.

Technical Bulletin #3 from Nilfisk of America, Inc., Malvern, PA entitled "Vitrification Coverage Efficiency", 1990.

Technical Bulletin #4 from Nilfisk of America, Inc., Malvern, PA entitled "Vitrification: Consumption of Chemicals", 1990.

Technical Bulletin #5 from Nilfisk of America, Inc., Malvern, PA entitled "Vitrification vs. Polymers", 1990.

Technical Bulletin #6. from Nilfisk of America, Inc., Malvern, PA entitled "MOHS Scale of Hardness", 1991.

Informational Sheet from Nilfisk of America, Inc., Malvern, PA for Mirror Magic training programs.

Advertising brochure from Nilfisk of America, Inc., Malvern PA entitled "Vitrification: The most durable, beautiful, and efficient way to maintain marble and terrazzo flooring", 1990.

Advertising sheet from Alpha Professional Tools, Wyckoff, New Jersey entitled "Natural Stone Polishing System".

Advertising sheet from Multi Seal Marbe Care Products, Alhambra, CA entitled "Welcome to your Marble Care Center".

*Primary Examiner*—Timothy V. Eley

*Attorney, Agent, or Firm*—Senniger, Powers, Leavitt & Roedel

[57] ABSTRACT

A self-propelled battery operated stone floor polishing machine having dual rotating heads with detachable stone grinding, honing, and polishing pads. The polishing machine includes an integral solution tank for applying a liquid lubrication to the floor through the heads, a recovery tank for collecting the slurry generated by the grinding, honing, and polishing action, and an integral squeegee system that removes the liquid and particle slurry and thereafter transfers the slurry to the recovery tank. The grinding pads are integrated with metallic alloys, bonding industrial diamond abrasives for grinding marble, granite, poured terrazzo, precast terrazzo, cement, concrete, porcelain tile, ceramic tile, teracotta tile, but are not limited to these stone surfaces. A single operator may grind, hone, and polish up to 1,500 square feet of stone floors in a normal work day.

15 Claims, 3 Drawing Sheets

STONE POLISHING APPARATUS AND METHOD

BACKGROUND OF THE INVENTION

1. Field of the Invention

The present invention relates generally to the polishing of stone surfaces and, more particularly, to machinery and methods for grinding, honing, and polishing stone floors.

2. Description of the Prior Art

Many large commercial and industrial buildings have floors that are made of stone or some other similar hard surface. Marble and granite are two examples of the type of hard material used for flooring. These floors, like any other flooring material, are subject to wear and tear caused by pedestrian and machine traffic continually scuffing, scraping, and unevenly compressing the floor. Cleaning methods such as waxing and stripping can also be a source of wear and tear. Repeated waxing and stripping of stone surfaces is generally used by building maintenance since it is quite affordable to utilize a synthetic wax. However, for proper surface maintenance of stone floors, waxing and stripping is not desirable.

For proper maintenance of stone floors, it is necessary to apply a natural polish to the floor surface. A natural polish consists of constituents of the floor substrate, is naturally bonded to the floor substrate, is compatible with itself, and never needs to be stripped with harsh chemicals.

Furthermore, it is necessary from time to time, to grind the floor as well as polish it in order to remove scrapes, scratches, and unevenness due to the wear and tear of traffic and produce an aesthetically pleasing sheen to the floor.

From a long-term care and maintenance standpoint, it is thus preferred to grind, hone, and polish stone surfaces with a natural polish than it is to wax, strip, and rewax. However, the current state of the art of grinding, honing, and polishing stone floors makes it time consuming and expensive to accomplish. Therefore, such care is not being given to stone floors.

The prior art stone polishing machines and methods utilized a manually operated rotary buffer polishing machine in conjunction with a separate manually operated wet vacuum machine to perform the stone grinding, honing, and polishing process. Two men were required to conduct the floor polishing operation, one to operate the rotary buffer machine, and the other to operate the wet vacuum.

The prior art is thus inefficient in several respects. First, a two man crew is required, one to operate the rotary buffer and one to operate the wet vacuum. Another problem is that the rotary buffer and wet vacuum need to both be connected to standard AC via electrical cords. Oftentimes, the AC outlets are inconveniently placed, while the electrical cords are cumbersome and must be plugged into the AC outlets. The electrical cords may also be run over by the machines and be exposed to the wet floor.

Furthermore, the prior art machines and methods are only able to complete approximately 200 square feet per day of grinding, honing, and polishing of stone floors, assuming an eight hour work shift. Thus, it is quite time-consuming to completely polish a large floor area.

It is thus an object of the present invention to provide a stone floor polishing machine and method that requires only a single operator to effectively and efficiently grind, hone, and polish a stone floor.

It is another object of the present invention to provide a stone floor polishing machine and method that is less time consuming to completely polish a large floor area compared with the prior art.

It is further an object of the present invention to provide a stone floor polishing machine and method which is easier to use than the prior art.

These and other objects are attained by the present invention of which the following is a summary.

SUMMARY OF THE INVENTION

The present invention provides a self-propelled, battery powered, stone floor polishing machine that requires only a single worker to operate and steer. The stone floor polishing machine includes an integral solution holding tank, a dual head assembly for detachably carrying rotatable grinding, honing, or polishing discs, a vacuum system for recovering the slurry produced by the various steps, and an integral recovery tank for depositing and storing the slurry for eventual discarding.

The necessary liquid lubrication for the grinding, honing, and polishing discs is supplied from the solution tank directly to the dual heads without the need for hand application. The squeegee system is coupled to the recovery tank such that the slurry generated by the grinding, honing, and polishing is vacuumed from the floor by the squeegee system and deposited into the recovery tank for disposal.

The grinding discs include industrial grade diamonds bonded with metallic alloys, such as iron/steel bonds, commonly referred to as sintered, or cobalt bonds. The honing discs include industrial grade diamonds bonded with a thermoset phenolic plastic bond. The honing discs are of several variable grit/mesh sequences, depending on the materials to be honed.

Other bonds may be alternatively utilized, such as metallic-plastic bonds, two part epoxy cold set bonds, two part epoxy thermoset bonds, and any combination thereof.

In one form thereof, the present invention provides a self-propelled stone polishing machine comprising a frame, a housing carried by the frame with the housing defining a first tank, a second tank, and an interior chamber. The stone polishing machine includes a battery that is disposed within the interior chamber, and a drive assembly including a motor and a wheel drivingly coupled to the motor. The drive assembly is coupled to the battery for obtaining electrical energy therefrom and is adapted to propel the frame and thus the stone polishing machine. A pad driver assembly is carried by the frame, the pad driver assembly including a disc pad rotatably coupled to a driver motor, with the disc pad having a stone abrading surface on one side thereof adapted to rotatably contact the floor. The driver motor is coupled to the battery for obtaining electrical energy therefrom. A conduit is in communication with the first tank and the disc pad, the first tank containing a liquid lubricant and the conduit is adapted to deliver the liquid lubricant between the disc pad and the floor such that the rotating contact action of the stone abrading surface of the disc pad with the floor creates a slurry with the liquid lubricant. The stone polishing machine further includes a vacuum assembly in fluid communication with the second tank, the vacuum assembly including a squeegee carried by the frame and adapted to abut the floor. A vacuum pump is in communication with the second tank and the squeegee for vacuuming the slurry contacted by the squeegee on the floor and depositing the slurry into the second tank for later disposal.

The disc pad is detachably coupled to the drive motor for changing the type of disc pad. The stone abrading surface of the disc pad is comprised of a plurality of abrading discs that are detachably connected to said disc pad. The plurality of abrading discs may be one of a grinding, honing, or polishing grit/mesh size of industrial diamond embedded therein. In this manner, one may change the abrading discs or the entire disc pad having the various abrading discs thereon to effect a grinding, honing, and then polishing of the stone floor.

The present invention in one form thereof provides a method of polishing a stone floor with a self-propelled stone polishing machine having a solution tank with a liquid lubricant therein, a recovery tank, a vacuum assembly in communication between the floor and the recovery tank, and a disc pad driver assembly having a rotatable shaft. The method comprises the steps of attaching a disc pad having a stone abrading surface on one side to the rotatable shaft of the pad driver assembly such that the stone abrading surface is adjacent the floor, the disc pad being rotatable with the rotatable shaft. Applying the liquid lubricant from the solution tank to the area between the stone abrading surface of the disc pad and the stone floor. Rotating the disc pad so as to create a slurry from the liquid lubricant and the stone floor, and then moving the machine so that the vacuum assembly may contact the slurry to deposit the slurry in the recovery tank, and the rotating disc pad may contact another portion of the stone floor.

The present stone floor polishing machine is thus capable of permitting one worker to complete an approximately 1,500 square feet floor area in a seven hour work shift. This represents a seven fold increase over the prior art in terms of productivity, while representing a fourteen fold decrease in labor cost over two workers utilizing two separate machines as in the prior art.

BRIEF DESCRIPTION OF THE DRAWINGS

So that the manner in which the above-recited features, advantages, and objects of the present invention are attained and can be understood in detail, a more particular description of the invention, briefly summarized above, may be had by reference to the embodiments thereof which are illustrated in the appended drawings. Corresponding reference characters indicate corresponding parts throughout the several view.

It is noted, however, that the appended drawings illustrate only a typical embodiment of this invention and is therefore not to be considered limiting of its scope, for the invention may admit to other equally effective embodiments. Reference the appended drawings, wherein.

DESCRIPTION OF THE PREFERRED EMBODIMENT

Prior Art

Figure 1:
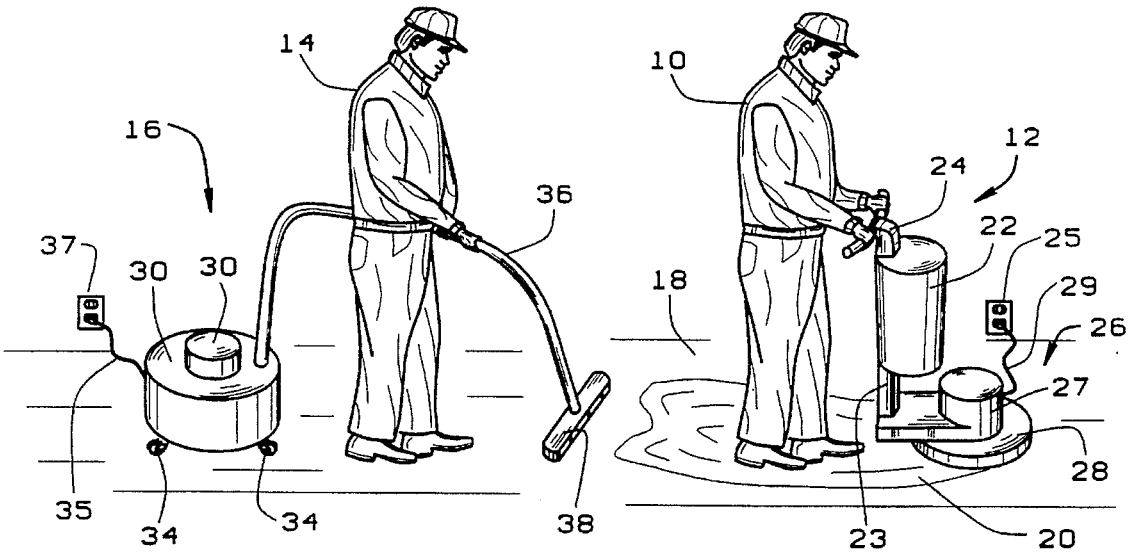
FIG. 1 PRIOR ART
FIG. 1 is a perspective view of the prior art apparatus utilized for grinding, honing, and polishing stone floors.

Referring to FIG. 1 there is shown the prior art apparatus utilized for grinding, honing, and polishing stone floors. A first worker or operator 10 is depicted operating a typical rotary buffer 12 while a second worker or operator 14 is depicted operating a wet vacuum 16. The rotary buffer 12 is either grinding, honing, or polishing floor 18, depending on what step is being accomplished in the overall process. The rotary buffer 12 thus rotatably carries an appropriate disc pad that contacts the floor. The rotary buffer 12 generally consists of a solution tank 22 carried on a mast 23, the mast 23 terminating at one end in a handle assembly 24 that is gripped by the operator 10. Attached to the other end of the mast 23 is a head assembly 26 that includes a motor housing 27 and a disc driver housing 28. Disposed within motor housing 27 is a drive motor (not shown) and disposed within disc driver housing 28 is a grinding, honing, or polishing pad detachably secured to a disc driver (not shown) that is rotatably coupled to the motor (not shown). The type of disc depends on the particular function being performed by the rotary buffer 12 at that particular time. The rotary buffer 12 is connected to a typical AC power source, here a wall outlet 25, via an electrical cord 29 in order to operate the motor (not shown).

The wet vacuum 16 operated by the worker 14 generally consists of a housing 30 that defines an internal liquid storage tank (not shown) and a motor housing 32 that surrounds a vacuum motor (not shown). The housing 30 is movably carried by a plurality of casters, collectively numbered 34 so as to be mobile. A hose or conduit 36 is attached to housing 30 so as to be in communication with the internal liquid storage tank (not shown) defined by housing 30. Hose or conduit 36 includes a head attachment 38 for contacting the floor 18. The wet vacuum 16 is connected to a typical AC power source, here wall outlet 37, via an electrical cord 35 in order to operate the motor (not shown).

As shown, the worker 10 controls the rotary buffer 12 through various controls (not shown) on handle assembly 24 and must guide and push rotary buffer 12 in the desired direction in order to effect the grinding, honing, or polishing process. A liquid contained in the solution tank 22 is fed to the rotating discs (not shown) during the grinding, honing, and polishing steps. The grinding, honing, or polishing steps along with the applied solution, forms a slurry 20 that remains on the floor surface. The second worker 14 must vacuum the slurry 20 from the floor while the first worker 10 continues the grinding, honing, or polishing. The slurry 20 is vacuumed up into wet vacuum 16 via a head attachment 38 and a hose 36 which is then deposited into the internal storage tank (not shown) defined by housing 30.

Present Invention

Figure 2:
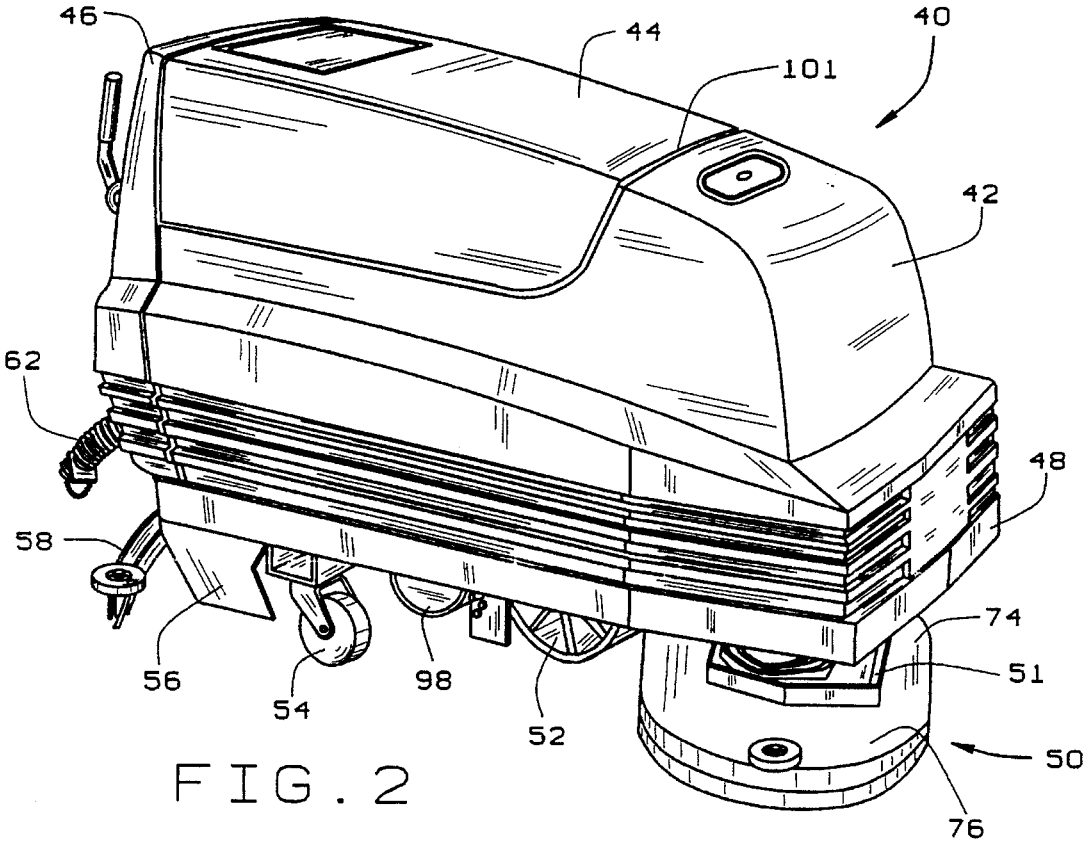
FIG. 2 is a perspective view of the present stone polishing apparatus.

Referring now to FIG. 2 there is shown an embodiment of the present stone polishing apparatus generally designated 40. The stone polishing apparatus 40 includes a main body 42, a recovery tank housing 44, and a rear portion 46. The main body 42 and the rear portion 46 fit onto and are support by a frame 48. Extending from the underside of frame 48 is a head attachment assembly 51, a head assembly 50, a drive wheel 52, a pair of guide wheels 54, 55 (see also FIG. 3), a drive motor 98, a rear guard 56, and a squeegee assembly 58.

Figure 3:
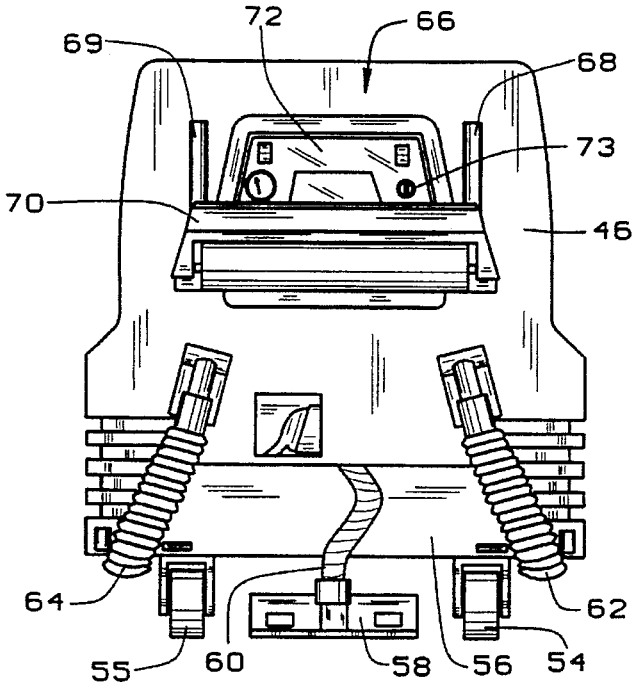
FIG. 3 is a rear view of the present stone polishing apparatus.

The rear portion 46 of stone polishing apparatus 40 is depicted in FIG. 3. Disposed in rear portion 46 is a control assembly 66 that includes right and left handles 68, 69 supported on a bar 70, and an indicator panel 72 that includes various gauges for indicating the state of the various components, such as volume of liquid in the solution and recovery tanks described below, battery power, etc., for monitoring of the same, and an on/off switch 73. The worker or operator guides or steers the polishing apparatus 40 by grasping the handles 68, 69.

Figure 5:
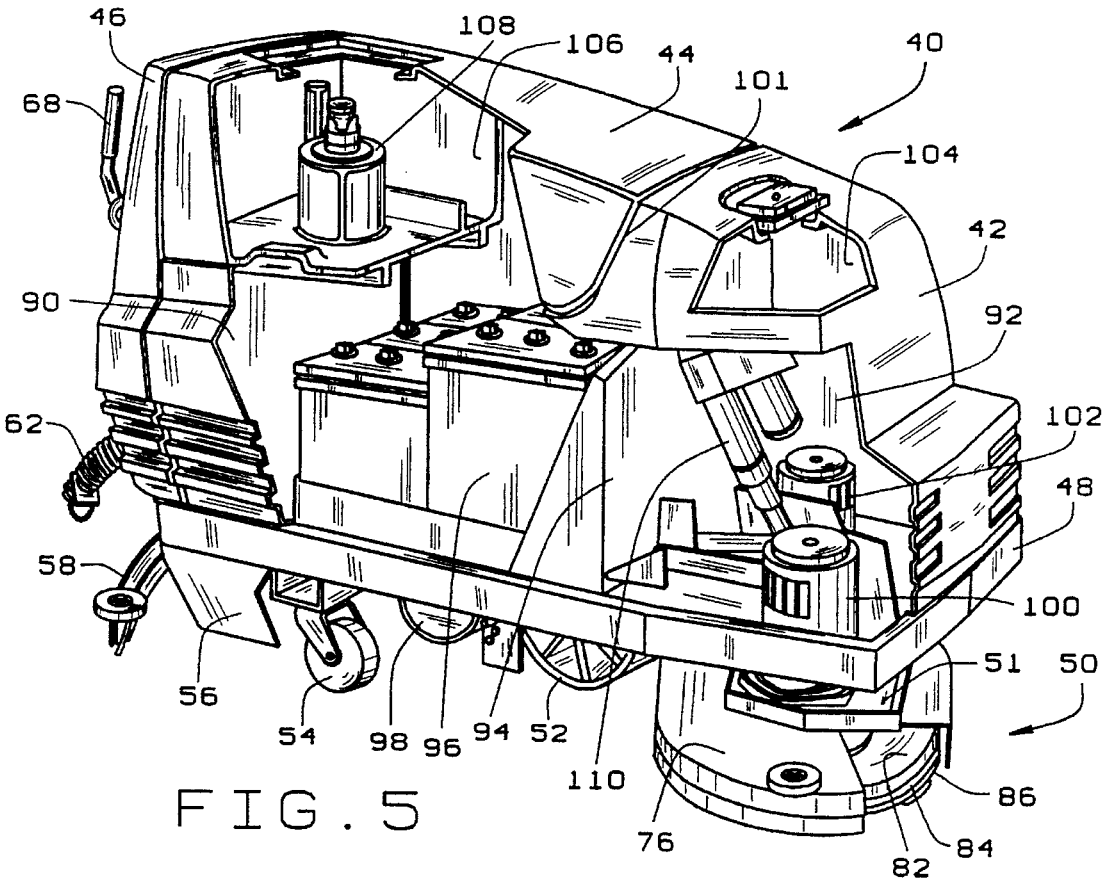
FIG. 5 is a perspective view of the present stone polishing apparatus in a partial section showing the internal structure thereof.

With reference to FIG. 5, the internal structure of the polishing apparatus 40 will now be described. As noted above, frame 102 supports main body 42. Main body 42 is essentially a shell, that together with partition or bulkhead 94, defines a first interior chamber 90 and a second interior chamber 92. First interior chamber 90 houses a plurality of batteries 96 and partially houses a drive motor 98 that is drivingly coupled to drive wheel 52 and obtains power from the batteries 96. In this manner polishing apparatus 40 is self-propelled, such that the operator need only steer. Main body 42 includes a cutout portion 101 on the top surface thereof in which is disposed recovery tank housing 44. Recovery tank housing 44 has an interior recovery tank 106 in which is situated a pump 108. Pump 108 is coupled to squeegee assembly 58 via a hose or conduit 60 (FIG. 3), such that liquid encountered by squeegee 58 will be vacuumed into recovery tank 106 via hose 60 by pump 108.

The front portion of main body 42 defines second interior chamber 92 in which is disposed first and second pad driver motors 100, 102 that are electrically coupled to batteries 96. First and second pad driver motors 100, 102 independently drive or rotate pad plates, of which only one pad plate 82 is depicted. Main body 42 also defines an enclosed solution tank 104 disposed above second interior chamber 92. Solution tank 104 is used for storing a liquid solution, such as liquid aluminum oxide, to be applied to the floor during the grinding, honing, and polishing process. The liquid solution stored in the solution tank 104 is supplied to each pad via a conduit 110. In this manner, the solution may be continuously applied to the floor through the rotating heads, such that the solution lubricates and provides natural polish to the floor for the grinding, honing, and polishing process.

Figure 4:
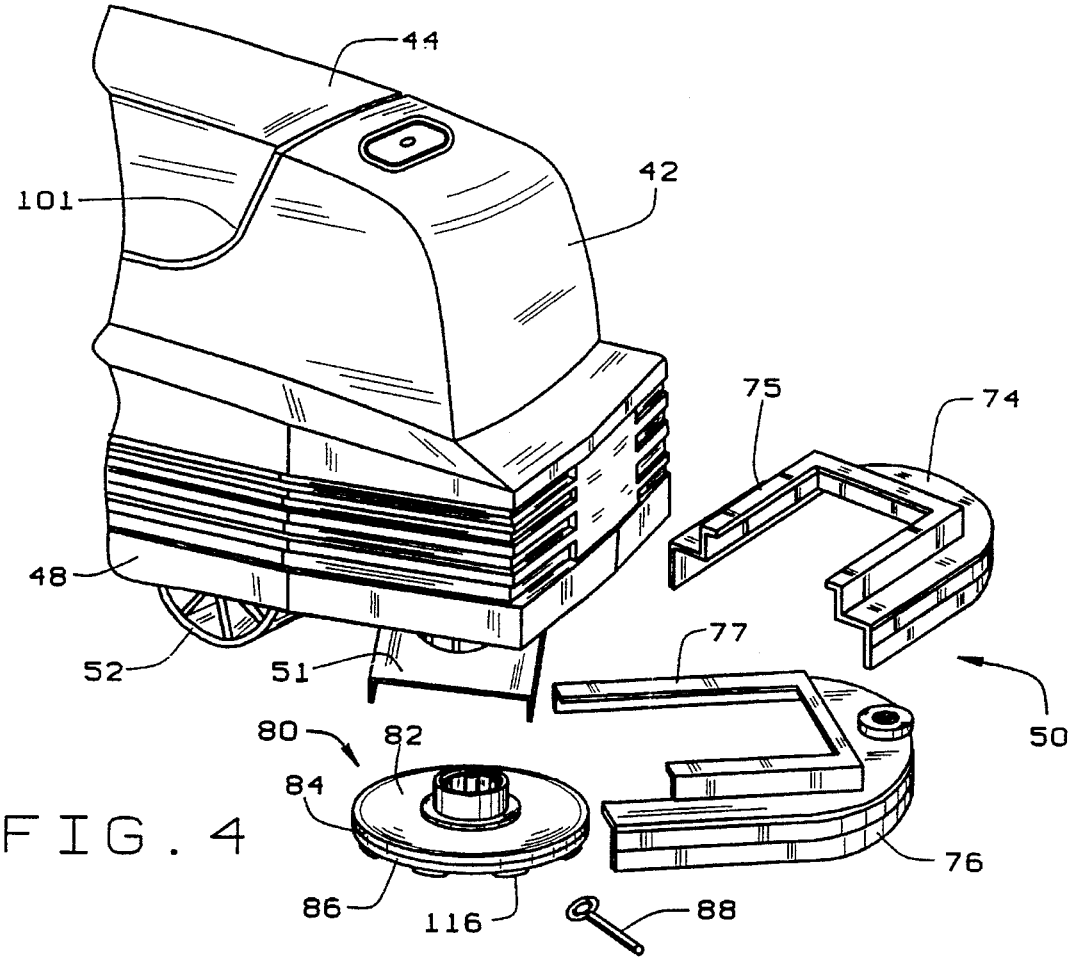
FIG. 4 is a partial front elevation view of the present stone polishing apparatus showing the disc assembly detached from the head assembly.

Disposed on the underside of frame 48 proximate the front portion of main housing 42 is head assembly 50. Additionally referring to FIG. 4, head assembly 50 includes a rectangular-shaped frame member 51 that is swivably attached to frame 48, and a first and second driver housing 74, 76. First and second driver housing 74, 76 are each adapted to be removably attached to rectangular-shaped member 51 through respective first and second rectangular ridges 75, 77 that slide onto rectangular frame 51 and are locked in place by a pin or key 88. Head assembly 50 further includes two pad assemblies of which only one pad assembly 80 is shown. It should be understood that the pad assembly not shown is identical in form, function, and manner of operation to pad assembly 80. Furthermore, although the present embodiment has two pad assemblies, a single pad assembly or a plurality of pad assemblies may be utilized. Pad assembly 80 includes a circular driver plate 82 that is drivingly coupled to the respective driver motor, here driver motor 100. Drivingly coupled to the underside of driver plate 82 is a pad driver 84, while a pad 86 is attached to the underside of pad driver 84. Disposed on the underside of pad 86 are a plurality of discs 116 that contact the stone floor surface to do the grinding, honing, and polishing thereof.

Figure 6:
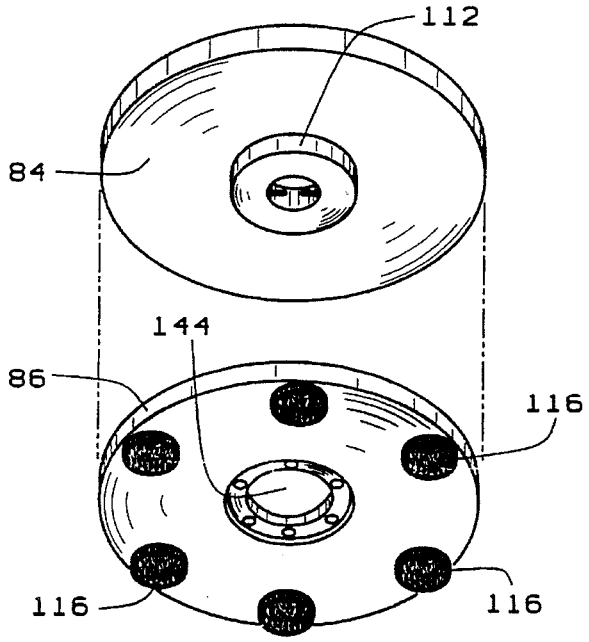
FIG. 6 is an enlarged diagrammatic view of a disc pad and disc pad driver utilized in the present stone polishing apparatus.

As can be seen in detail with reference to FIG. 6, pad driver 84 includes a circular ridge 112 that matingly fits into an opposite circular hollow 114 in pad 86. Disposed on the periphery of pad 86 are a plurality of grinding, honing, or polishing discs, collectively labeled 116. Discs 116 are removably fastened to pad 86 such that different discs may be utilized depending on whether one is grinding, honing, or polishing the stone floor.

Figure 7:
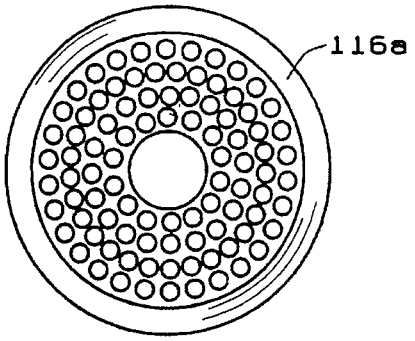
FIG. 7 is an enlarged bottom view of a honing disc.

FIG. 7 depicts a typical disc **116*a*** that is used for the grinding step or process. This type of disc utilizes industrial grade diamonds with bonds preferred to be iron/steel bonds, commonly referred to as sintered or cobalt bonds. Thermoset phenolic plastic bonds may also be utilized.

Figure 8:
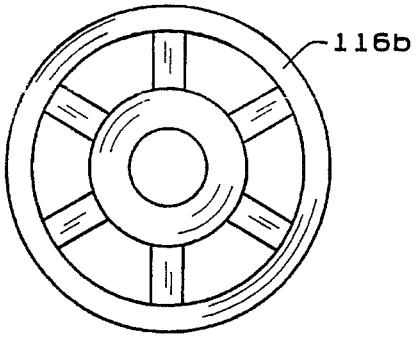
FIG. 8 is an enlarged bottom view of a grinding disc.

FIG. 8 depicts a typical disc **116*b*** that is used for the honing step or process. The honing discs, as well as the grinding discs, come in a range of grit/mesh sizes depending on the type of stone surface being ground, honed, and polished. The honing discs utilize industrial grade diamonds with bonds preferred to be thermoset phenolic plastic bonds. However, the grinding and honing bonds are not limited to only those bonds enumerated above, and may include metallic-plastic bonds, two part epoxy cold set bonds, two part epoxy thermoset bonds, and any combination thereof that are acceptable as grinding, honing, and polishing discs. Such discs lend themselves to the grinding, honing, and polishing of stone surfaces such as marble, granite, poured terrazzo, precast terrazzo, cement, concrete, porcelain tile, ceramic tile, teracotta tile, but are not limited to these stone surfaces.

Operation

With regard to FIGS. 1–8, the manner of operation of the present stone polishing apparatus 40 will now be described. The following description of operation assumes that the stone floor will be ground, honed, and polished. However, the stone floor may just be polished, in which event, only the polishing pad will be used.

Depending on the surface to be finished, the operator selects a grinding pad having discs of a certain grit/mesh and attaches such pad 86 to the pad driver 84. The pad driver 84 is attached to the driver plate 82. In this manner, when the respective motor 100 or 102 rotates, the driver plate 82, pad driver 84, pad 86, and discs 116 rotate to interact with the floor. The solution tank 104 is filled with a liquid lubrication solution, such as a liquid aluminum oxide cream solution. The polishing apparatus 40 is ready to operate.

The polishing apparatus 40 is activated such that the first and second pad driver motors 100, 102 coupled to the batteries 96 rotate the respective pads within head assembly 50. At the same time the solution with the solution tank 104 is caused to drip into the head assembly 50 via line 110 such that the solution lubricates the floor underneath the rotating discs. The drive motor 98 powered by the batteries 96 allow the apparatus to be self-propelled by being drivingly coupled to wheel 52. The operator steers the polishing apparatus 40 via handles 68, 69.

As the polishing apparatus 40 moves along a grinding path, a slurry trail or pool is left behind. When squeegee assembly 58 encounters the slurry on the floor the suction pump 108 causes the slurry to be drawn into the recovery tank via conduit 60 to be later discarded. Once the grinding process is complete, the operator changes pads to a pad having honing discs of a selected grit/mesh depending on the stone surface. The process is repeated. Once the honing process is complete, the operator changes pads to polishing pad, and the process is repeated.

Thus what has been accomplished with the present invention is the complete grinding, honing, and polishing of a stone surface by a single operator, one that may be less inclined or unskilled in the art of polishing.

While the foregoing is directed towards the preferred embodiment of the present invention, other and further embodiments of the invention may be devised without departing from the basic scope thereof, and the scope thereof is determined by the claims which follow.

What is claimed is:

1. A method of polishing a stone floor with a self-propelled stone polishing machine having a solution tank with a liquid lubricant therein, a recovery tank, a vacuum assembly for removing material from the floor and delivering it to the recovery tank, and a disc pad driver assembly having a rotatable shaft, the method comprising the steps of:

attaching a disc pad having a stone abrading surface on one side to the rotatable shaft of the pad driver assembly such that the stone abrading surface is adjacent the floor, the disc pad being rotatable with the rotatable shaft;

applying the liquid lubricant from the solution tank to the area between the stone abrading surface of the disc pad and the stone floor;

rotating the disc pad to abrade a portion of the stone floor so as to create a slurry from the liquid lubricant and the stone floor; and moving the machine so that the vacuum assembly contacts the slurry to deposit the slurry in the recovery tank, and the rotating disc pad contacts another portion of the stone floor.

2. The method of polishing a stone floor of claim 1, wherein said attaching step comprises removably attaching said disc pad to said rotatable shaft.

3. The method of polishing a stone floor of claim 2, wherein said attaching step comprises attaching a grinding disc pad to said rotatable shaft, followed by said applying, rotating and moving steps, said method further comprising attaching a honing disc pad to the rotatable shaft, repeating said applying, rotating and moving steps, attaching a polishing disc pad to the rotatable shaft, and repeating said applying, rotating and moving steps.

4. A machine for wet polishing stone floors comprising:

a frame;

a solution tank carried by said frame, for holding a liquid lubricant;

a head assembly carried by said frame, said head assembly including a disc motor having a rotatable shaft;

a disc pad detachably carried by said head assembly and coupled to said shaft for rotation therewith, said disc pad having a stone abrading surface on one side adapted to be in contact with the floor for rotating thereon and effecting abrading thereof, said solution tank being in fluid communication with said disc pad and being adapted to supply the liquid lubricant between said floor and said disc pad to create a slurry when said disc pad is effecting abrading of the floor;

a squeegee assembly carried by said frame for wiping the slurry from the floor;

a recovery tank in fluid communication with said squeegee assembly; and a pump in communication with said recovery tank and said squeegee assembly for transferring the slurry from said squeegee assembly to said recovery tank.

5. The stone floor polishing machine of claim 4, further comprising:

a storage battery supplying electrical power to drive said disc motor and said pump;

a drive motor coupled to said battery; and a drive wheel disposed underneath said frame and coupled thereto, said drive wheel drivingly coupled to said drive motor such that the polishing machine is propelled thereby.

6. The stone floor polishing machine of claim 4, wherein said head assembly is pivotably attached to said frame.

7. The stone floor polishing machine of claim 4, wherein said stone abrading surface is comprised of a plurality of abrading discs.

8. The stone floor polishing machine of claim 7, wherein said plurality of abrading discs are detachably connected to said disc pad.

9. The stone floor polishing machine of claim 7, wherein said plurality of abrading discs have industrial diamonds embedded therein.

10. A self-propelled stone polishing machine comprising:

a frame;

a housing carried by said frame, said housing defining a first tank, a second tank, and an interior chamber;

a battery disposed within said interior chamber;

a drive assembly including a motor and a wheel drivingly coupled to said motor, said drive assembly coupled to said battery for obtaining electrical energy therefrom and adapted to propel said frame;

a pad driver assembly carried by said frame, said pad driver assembly including a disc pad rotatably coupled to a driver motor, said disc pad having a stone abrading surface on one side thereof adapted to rotatably contact the floor, said driver motor coupled to said battery for obtaining electrical energy therefrom;

a conduit in communication with said first tank and said disc pad, said first tank containing a liquid lubricant and said conduit adapted to deliver the liquid lubricant between the disc pad and the floor such that the rotating contact action of said stone abrading surface of said disc pad with the floor creates a slurry with the liquid lubricant; and a vacuum assembly in fluid communication with said second tank, said vacuum assembly including a squeegee carried by said frame and adapted to abut for wiping said slurry from the floor, and a vacuum pump in communication with said second tank and said squeegee for vacuuming the slurry contacted by said squeegee on the floor and depositing the slurry into said second tank for later disposal.

11. The self-propelled stone polishing machine of claim 10, wherein said pad driver assembly is pivotably coupled to said frame.

12. The self-propelled stone polishing machine of claim 10, wherein said disc pad is detachably coupled to said drive motor.

13. The stone floor polishing machine of claim 10, wherein said stone abrading surface is comprised of a plurality of abrading discs.

14. The stone floor polishing machine of claim 13, wherein said plurality of abrading discs are detachably connected to said disc pad.

15. The stone floor polishing machine of claim 13, wherein said plurality of abrading discs have industrial diamonds embedded therein.

* * * * *

UNITED STATES PATENT AND TRADEMARK OFFICE

CERTIFICATE OF CORRECTION

PATENT NO. : 5,605,493

DATED : February 25, 1997

INVENTOR(S) : Joseph M. Donatelli et al.

It is certified that error appears in the above-indentified patent and that said Letters Patent is hereby corrected as shown below:

Column 8, claim 10, lines 45-46, "frame and adapted to abut for wiping" should read ---frame for wiping---.

Signed and Sealed this

Twenty-ninth Day of July, 1997

Bruce Lehman

*Attest:*

BRUCE LEHMAN

*Attesting Officer*

*Commissioner of Patents and Trademarks*